United States Patent [19]

Altherr

[11] Patent Number: 5,054,630

[45] Date of Patent: Oct. 8, 1991

[54] SLACKLESS COUPLER CONNECTION FOR A RAILWAY VEHICLE

[75] Inventor: Russell G. Altherr, Munster, Ind.

[73] Assignee: Canon Kabushiki Kaisha, Tokyo, Japan

[21] Appl. No.: 518,925

[22] Filed: May 4, 1990

[51] Int. Cl.[5] ..... B61G 7/00

[52] U.S. Cl. ..... 213/56; 213/60

[58] Field of Search ..... 213/50, 56, 58, 61, 213/60, 62 R, 63, 62 A, 64, 12, 18, 71, 74; 105/3

[56] References Cited

U.S. PATENT DOCUMENTS

| | | | |
|---|---|---|---|
| 3,104,017 | 9/1963 | Kulieke et al. | 213/61 |
| 3,881,602 | 5/1975 | Altherr et al. | 213/62 |
| 4,593,827 | 6/1986 | Altherr et al. | 213/56 |
| 4,637,518 | 1/1987 | Hanula | 213/62 A |
| 4,700,853 | 10/1987 | Altherr et al. | 213/62 A |

FOREIGN PATENT DOCUMENTS

| | | | |
|---|---|---|---|
| 1253864 | 2/1986 | U.S.S.R. | 213/62 R |

*Primary Examiner*—Robert J. Oberleitner

*Assistant Examiner*—Mark T. Le

*Attorney, Agent, or Firm*—Fitzpatrick, Cella, Harper & Scinto

[57] ABSTRACT

In a railway coupler connection, an improved slackless connection in which an arcuate conical surface is provided about the butt end of a vertically restrained coupler member which is seated within the pocket of a self-adjusting follower member having a corresponding arcuate conical surface about a pocket therein. The corresponding arcuate conical surfaces interface in mated alignment in order to permit horizontal angling of the coupler member while restraining the butt end of the coupler member in a lateral and longitudinal position within the center sill. As in-service wear occurs, the self-adjusting follower member will drop with respect to the coupler member to maintain this zero-slack arrangement. The coupler member may be placed in the upper portion of the center sill permitting a lower center sill height while staying within the coupler height range specified by the American Association of Railroads.

25 Claims, 7 Drawing Sheets

13
13
51
38
38
20
20
18
18
40
40
22
68
68
82
82
160
54
56
162
56
26
60
163
164
166
86
84
94
36
36
48
48
50
50
42
42
44
44
24
24
150
150
152
154
158
156
142
28
30
62
64
146
144
148
46
47

SLACKLESS COUPLER CONNECTION FOR A RAILWAY VEHICLE

BACKGROUND OF THE INVENTION

The present invention relates generally to railway coupler connections and more particularly to an improved slackless coupler connection in which a vertically restrained coupler member is permitted to angle horizontally while the butt end of the coupler member is laterally and longitudinally restrained within the center sill by a self-adjusting follower member.

Railway cars are connected together by coupler members, namely drawbars or couplers. Drawbars are integral units known to be used in the railroad industry to extend between and permanently connect two or more railcars. Couplers are independent units on each car which interconnect with one another, between adjacent cars, to form a connection. In either instance, a shank and butt end of the drawbar or coupler extends into the center sill of a railway car where it is secured to transmit longitudinal loads to the car.

One problem which arises in coupler connections is excessive slack. Horizontal angling of the coupler member which occurs during the negotiation of curves cannot be accommodated by a coupler member with a square butt end unless there is slack between the butt end of the coupler member and a follower block which takes the buff load from the coupler member. However, excessive slack causes impact forces which can result in car instability and damage to the railway car and the lading thereon. Hence a slackless coupler connection between the coupler member and the center sill is desirable.

U.S. Pat. No. 4,700,853 discloses a coupler member which is positioned and held within the center sill of a railway car by the combination of a draft key assembly, follower block, tapered wedge and pocket casting, all of which longitudinally position the coupler member within the center sill and a pair of sill side castings which laterally position the coupler member within the center sill. A convex butt end of the coupler member fits against a concave matching face of the follower block. The tapered wedge drops to take up the slack which results. However, this arrangement requires multiple parts which adds weight as well as expense to the railcar.

SUMMARY OF THE INVENTION

Accordingly, it is an object of the present invention to provide a slackless railway coupler connection which will allow a coupler member to angle horizontally and which will restrain the butt end of the coupler member in a constant lateral and longitudinal position within the center sill.

By the present invention, it is proposed to overcome the difficulties encountered heretofore. To this end, it has been discovered that providing an arcuate conical surface about the butt end of a vertically restrained coupler member and seating the butt end of the coupler within the pocket of a self-adjusting follower member having a corresponding arcuate conical surface will result in a slackless coupler connection. The arcuate conical surfaces of the coupler member and the follower member interface in mated alignment and will permit horizontal angling of the coupler member while restraining the butt end of the coupler member in a lateral and longitudinal position within the center sill.

The interfacing arcuate conical surface configuration allows the follower member to drop as in-service wear between the surfaces occurs thereby maintaining the zero-slack positioning of the coupler member. This self-adjusting follower member performs all of the functions of the pocket casting, the tapered wedge, the follower block and the sill side castings of the prior art thus reducing weight and cost of the railway car.

Furthermore, since the coupler member is restrained against vertical angling, it may be placed in the upper portion of the center sill permitting an extremely low sill height while still remaining in the acceptable coupler height range set by the American Association of Railroads (AAR). The lower sill height can result in a lower overall car height which is desirable with respect to bridge clearance and space for lading. A lower center of gravity also results which reduces car rolling and tipping.

DETAILED DESCRIPTION OF THE INVENTION

Figures 1, 2:
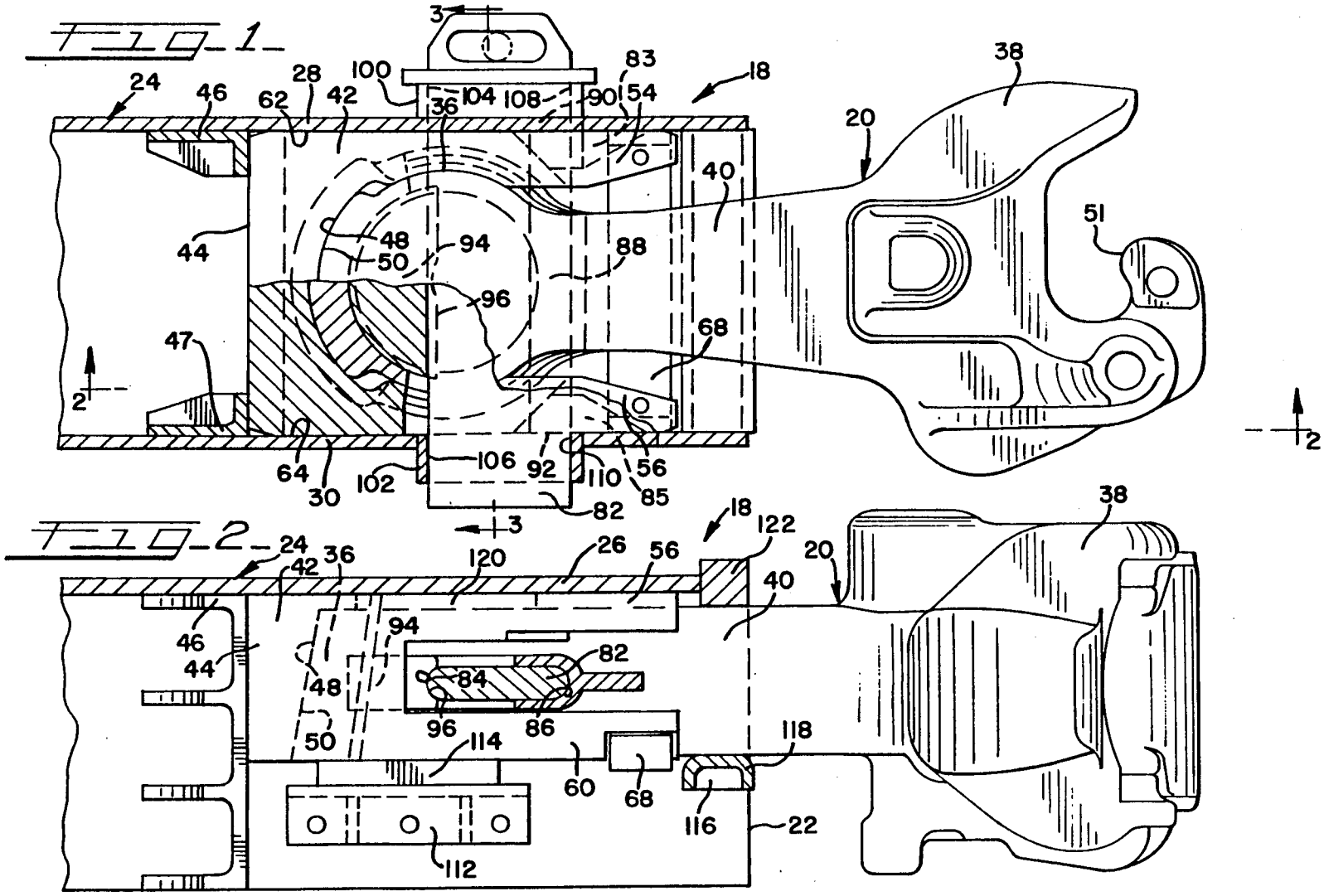
FIG. 1 is a sectional plan view of a first embodiment of the invention.
FIG. 2 is a side elevation of the first embodiment, partially in section taken along lines 2—2 of FIG. 1.
Figure 3:
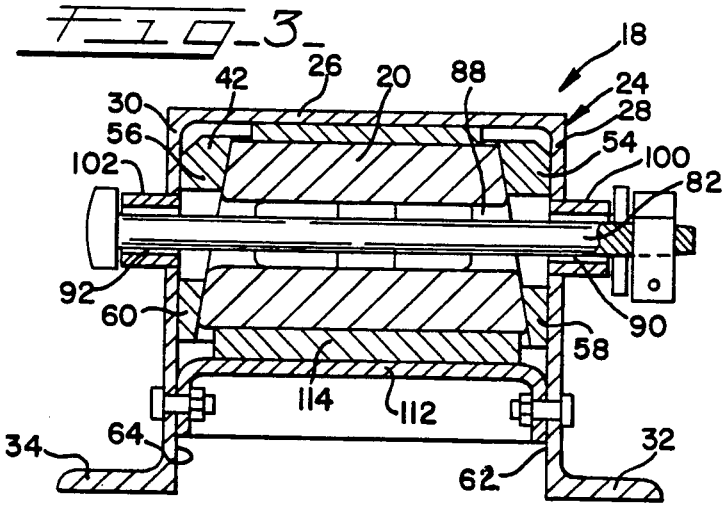
FIG. 3 is a sectional end elevation view of the first embodiment taken along lines 3—3 of FIG. 1.
Figure 4:
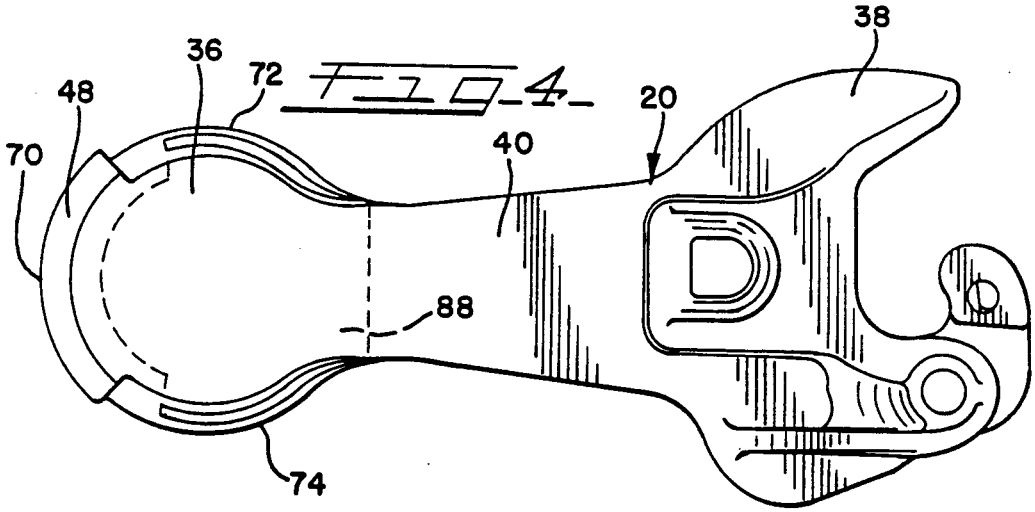
FIG. 4 is a plan view of the coupler member of the first embodiment of the invention.
Figure 5:
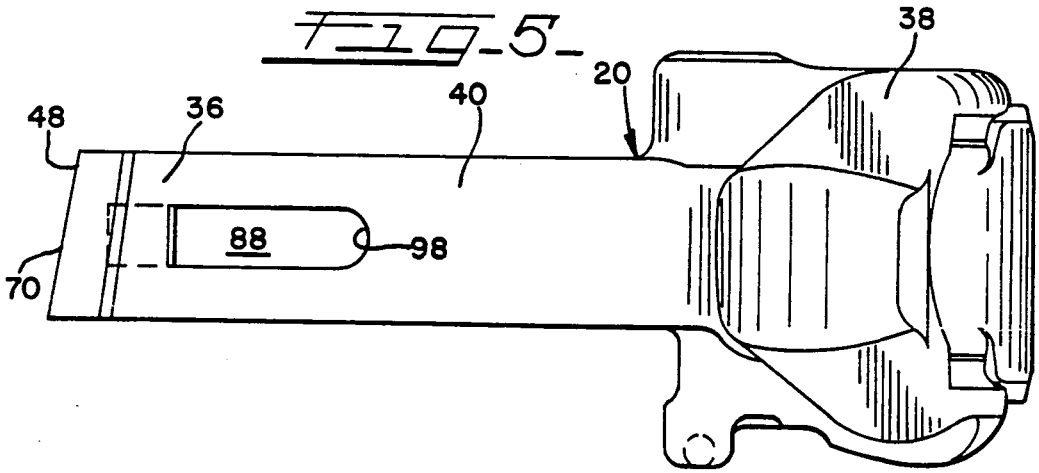
FIG. 5 is a side elevation of the coupler member shown in FIG. 4.

In FIGS. 1-3, a slackless coupler connection embodying the improved design of the present invention is shown generally at 18. A coupler member 20 extends within an open end 22 of a center sill, generally 24, which is secured longitudinally beneath a railway car (not shown). The center sill 24 is of a standard construction comprising an inverted U-shaped channel having a top roof portion 26, sidewalls 28 and 30 and outturned flanges 32 and 34 at the lower open bottom. The coupler member 20 includes a butt end 36, a head end 38 and a shank 40 located therebetween.

In accordance with the present invention, the butt end 36 of the coupler member 20 is both laterally and longitudinally positioned within the center sill 24 by a self-adjusting follower member 42 which partially surrounds the butt end 36 of the coupler member 20 in an arcuate manner. The coupler member 20 includes an arcuate surface 48 which interfaces with and is in mated alignment with an arcuate surface 50 of the follower member 42. The interfacing arcuate surfaces 48 and 50 of the coupler member 20 and the follower member 42, respectively, must be configured to allow horizontal angling of the coupler member 20 while restraining the butt end 36 of the coupler member 20 in a lateral and longitudinal position within the center sill 24. The interfacing arcuate surfaces 48 and 50 must further be capable of performing these functions even after the surfaces 48 and 50 become subjected to wear while in service. Such an arrangement will form a slackless coupler connection.

In the first embodiment of the invention, the interfacing arcuate surfaces 48 and 50 of the coupler member 20 and the follower member 42 respectively are in a mated conical alignment. This arrangement is used with a coupler member that does not angle vertically or which may be vertically restrained during operation such as the E type coupler member 20 shown in the figures. Vertical displacement of the E type coupler member 20 is instead accommodated during operation by sliding along the knuckles 51 of the coupler member 20 and an adjacent coupler member (not shown).

Figure 6:
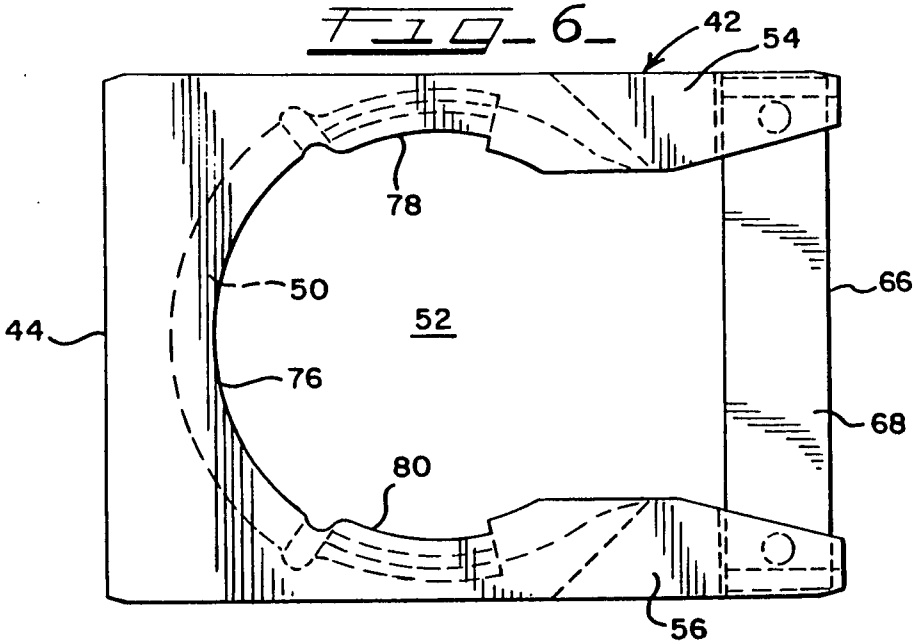
FIG. 6 is a plan view of the follower member of the invention.
Figure 7:
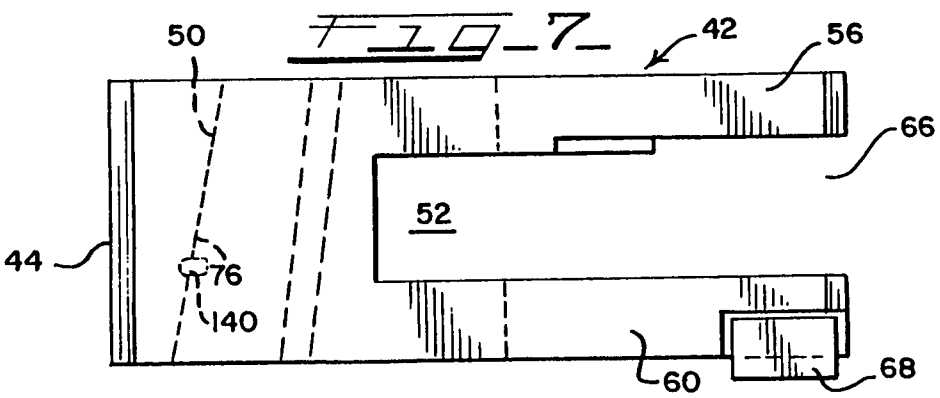
FIG. 7 is a side elevation of the follower member shown in FIG. 6.

The follower member 42 is shown in detail in FIGS. 6 and 7 and comprises a rear wall 44 adjacent to buff stop members 46 and 47 which are secured to the inner surfaces 62 and 64 of the center sill sidewalls 28 and 30 and which transfer buff loads to the center sill 24, as well as a pair of upper sidelegs 54 and 56 and lower sidelegs 58 and 60 which are adjacent to the inner surfaces 62 and 64 of the center sill sidewalls 28 and 30 respectively. The follower member 42 further includes an open front end 66 which leads to a pocket 52 for receiving the butt end 36 of the coupler member 20. A tie bar 68 may extend between and be bolted to the lower sidelegs 58 and 60 to resist spreading of the lower sidelegs 58 and 60 and to increase the rigidity of the follower member 42.

The arcuate conical surface 48 about the butt end 36 of the coupler member 20 comprises a rear bearing surface 70 as well as a pair of lateral bearing surfaces 72 and 74. The radius of curvature of the rear bearing surface 70 may be different than the radius of curvature of the lateral bearing surfaces 72 and 74 depending on the length and width dimensions of the center sill 24. In the alternative, all three surfaces 70, 72 and 74 may have a constant radius of curvature (not shown). The wall defined by the arcuate conical surface 48 about the butt end 36 of the coupler member 20 is tapered increasing in thickness from top to bottom.

The arcuate conical surface 50 about the pocket 52 of the follower member 42 comprises a rear bearing surface 76 corresponding to the rear bearing surface 70 of the coupler member 20 as well as a pair of lateral bearing surfaces 78 and 80 corresponding to the lateral bearing surfaces 72 and 74 of the coupler member 20. As shown in the first embodiment, the wall defined by the arcuate conical surface 50 of the follower member 42 is tapered decreasing in thickness from top to bottom mating with the opposite taper on the wall defined by the arcuate conical surface 48 of the coupler member 20.

The interface between the arcuate conical surface 48 of the coupler member 20 and the arcuate conical surface 50 of the follower member 42 accommodates the lateral motion (horizontal angling) of the coupler member 20 while restraining the butt end 36 of the coupler member 20 in a lateral and longitudinal position within the center sill 24. Thus, the butt end 36 of the coupler member 20 may rotate within the pocket 52 of the follower member 42 without slack as required in a square-butt end coupler member.

As the arcuate conical surfaces 48 and 50 are subjected to in-service wear, the self-adjusting follower member 42 will drop relative to the coupler member 20 which remains at the same height thereby maintaining zero slack. In other words, as the arcuate conical surfaces 48 and 50 wear, the radius of curvature of the arcuate conical surface 48 of the coupler member 20 becomes smaller while the radius of curvature of the arcuate conical surface 50 of the follower member 42 becomes larger thus causing the follower member 42 to drop with respect to the coupler member 20. Hence, the lateral and longitudinal position of the coupler member within the center sill remains the same even after in-service wear.

In the first embodiment, the coupler member 20 and the follower member 42 are secured longitudinally within the center sill 24 by a draft key 82, having rounded edges 84 and 86, which extends horizontally through a slot 88 in the coupler member 20 as well as slots 90 and 92 in the center sill sidewalls 28 and 30 respectively. The draft key 82 further extends between the upper legs 54 and 56 and the lower legs 58 and 60 of the follower member 42. The coupler slot 88 is arched toward the butt end 36 and retains therein a corresponding contoured arcuate key bearing block 94 which has a concave straight side 96 adapted to receive the convex edge 84 of the draft key 82. The head end side of the coupler slot 88 has a concave straight side 98 adapted to surround the convex edge 86 of the draft key 82 while allowing free movement of same. The aforementioned arrangement of draft key 82 while allowing free movement of same, key bearing block 94, and slots 88, 90 and 92 in addition to the interfacing arcuate conical surfaces 48 and 50 of the coupler member 20 and the follower member 42 respectively, permits the horizontal angling movement of the coupler member 20 within the center sill 14.

The slots 90 and 92 in the center sill sidewalls 28 and 30 may be extended outwardly by reinforcement flanges 100 and 102. The reinforcement flanges 100 and 102 have concave edges 104 and 106 respectively to receive the convex edge 84 of the draft key 82 and concave edges 108 and 110 respectively to receive the convex edge 86 of the draft key 82. The concave edges 108 and 110 of the reinforcement flanges 100 and 102 extend inside the center sill 24 from the center sill sidewalls 28 and 30 to minimize the unsupported length of the draft key 82 along its convex edge 86. The inward extension of the concave edges 108 and 110 are reinforced by ribs 83 and 85 respectively. The concave edges 108 and 110 transfer the longitudinal draft load of the coupler member 20 from the draft key 82 to the center sill sidewalls 28 and 30. Buff loads from the coupler member 20 are transferred from the butt end of the coupler member 20 through the interfacing arcuate conical surfaces 48 and 50 into the follower member 42 and then through the rear wall 44 of the follower member 42 into the buff stops 46 and 47 for distribution into the center sill 24.

The follower member 42 is held within the center sill 24 by the coupler member 20. The coupler member 20 is supported vertically within the center sill 24 towards the butt end 36 by a bolted support 112 and a support wear plate 114 and at the shank 40 by a carrier 116 and a carrier wear plate 118 all located below the coupler member 20. The coupler member 20 is further positioned vertically within the center sill 24 towards the butt end 36 by a spacer block 120 and at the shank 40 by a striker bar 122, both of which are attached proximate to the roof portion 26 of the center sill 24. The coupler member 20 is supported in the above manner parallel to the top roof portion 26 of the center sill 24 at all times and with minimum clearance between the top of the shank 40 and the top roof portion 26 of the center sill 24. The interfacing arcuate conical surfaces 48 and 50 thereby remain in mated alignment.

According to the present invention, since no space for vertical angling is required between the coupler member 20 and the top roof portion 26 of the center sill 24, the coupler member 20 and the follower member 42 may be positioned in the upper portion of the center sill 24 thereby permitting an extremely low sill height, while keeping the coupler height within the range specified by the AAR.

Figure 10:
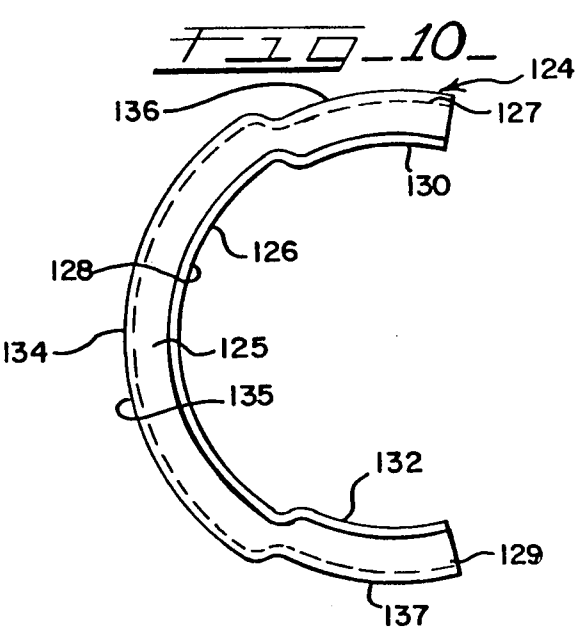
FIG. 10 is a plan view of the lining member of the second embodiment.
Figure 11:
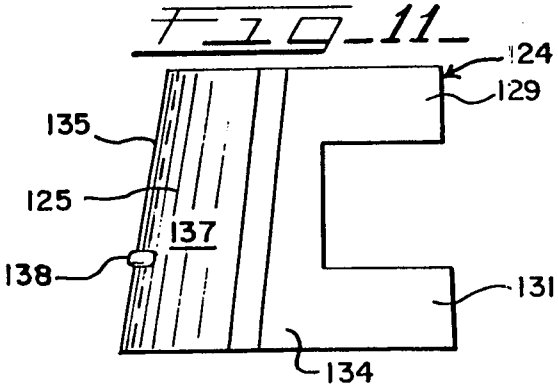
FIG. 11 is a side elevation of the lining member shown in FIG. 10.
Figures 8, 9:
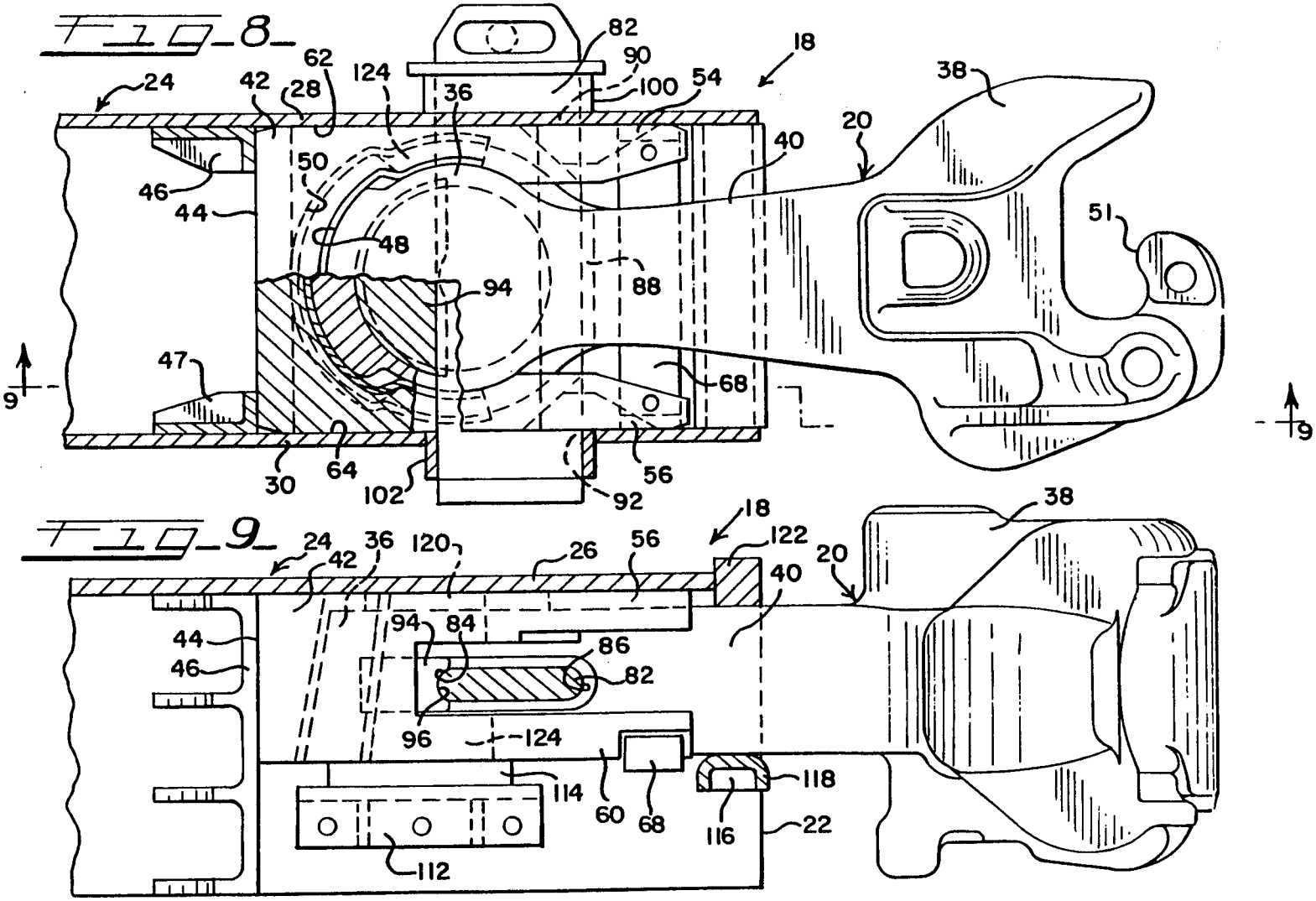
FIG. 8 is a sectional plan view of a second embodiment of the invention.
FIG. 9 is a side elevation of the second embodiment partially in section taken along lines 9—9 of FIG. 8.

A second embodiment is shown in FIGS. 8 and 9 and similar parts are shown with identical reference numerals. An arcuate wear-resistant liner 124 (shown in detail in FIGS. 10 and 11) is interposed between the butt end 36 of the coupler member 20 and surfaces 50, 78 and 80 of the follower member 42. The liner 124 may be made out of a metallic material such as a work hardening steel or a non-metallic material such as a polymer.

The liner 124 comprises a rear portion 125, a pair of upper sidelegs 127 and 129 corresponding to the upper sidelegs 54 and 56 of the follower member 42, and a pair of lower sidelegs 131 (the other lower sideleg not shown) corresponding to the lower sidelegs 58 and 60 of the follower member 42.

The liner 124 further comprises an inner arcuate conical surface 126 made up by a rear bearing surface 128 and a pair of lateral side bearing surfaces 130 and 132 which correspond in shape to and abut with the rear bearing surface 70 and the lateral side bearing surfaces 72 and 74 of the arcuate conical surface 48 about the butt end 36 of the coupler member 20. The arcuate wear-resistant liner 124 also comprises an outer arcuate conical surface 134 made up by a rear bearing surface 135 and a pair of lateral side bearing surfaces 136 and 137 which correspond to and abut with the rear bearing surface 76 and the lateral side bearing surfaces 78 and 80 of the arcuate conical surface 50 about the pocket 52 of the follower member 42.

As the radius of curvature along the arcuate conical surfaces 48 and 50 of the coupler member 20 and the follower member 42 varies, the sidelegs 127, 129 and 131 of the arcuate liner 124 may accordingly dog leg inwardly.

A radial step 138 may be included to orient and retain the arcuate liner 124 within a radial seat 140 in the arcuate conical surface 50 about the pocket 52 of the follower member 42.

The liner 124 provides a lower friction alternative to direct contact between the arcuate conical surfaces 48 and 50. Once the follower member 42 has dropped due to cumulative wear of the various elements to a vertical height which no longer eliminates slack, the arcuate wear-resistant liner 124 may be inserted thus restoring the follower member 42 to its original zero-slack position.

Figures 12, 13:
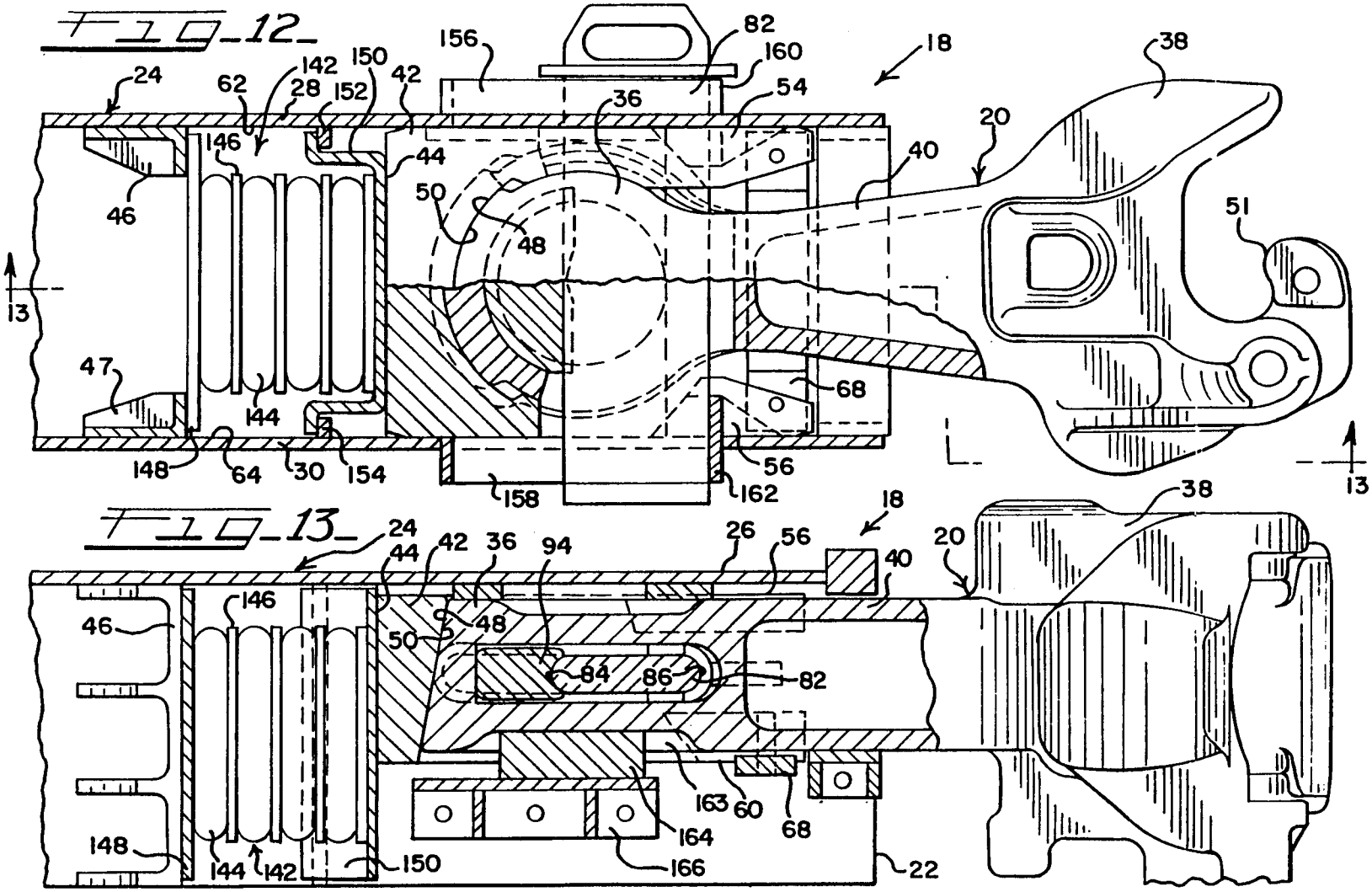
FIG. 12 is a sectional plan view of a third embodiment of the invention.
FIG. 13 is a side elevation of the third embodiment, partially in section taken along lines 13—13 of FIG. 12.

A third embodiment is shown in FIGS. 12 and 13 in which a cushioning assembly 142 is interposed between the buff stop members 46 and 47 and the rear wall 44 of the follower member 42. The cushioning assembly 142 absorbs the shock from buff impacts such as sudden stops or the coupling of two railway cars. The cushioning assembly comprises a plurality of alternating elastomeric pads 144 and spacer plates 146 as well as a flat rear bearing plate 148 in abutment with the buff stop members 46 and 47 and a front cushion cap member 150 to take the buff impact from the rear wall 44 of the follower member 42. The front cushion cap member 150 is limited from movement toward the follower member 42 by sill stops 152 and 154 which are attached to the sidewalls 28 and 30 of the center sill 24 respectively.

To allow for the cushioning assembly 142 to be effective, the follower member 42 and the coupler member 20 must be capable of sliding longitudinally within the center sill 24. Accordingly, longitudinally elongated slots 156 and 158 with longitudinally elongated reinforcement flanges 160 and 162 are included in the sidewalls 28 and 30 of the center sill 24 respectively. Furthermore, the coupler member 20 has a lower cavity 163 in which a slidable vertical support wear plate 164 is located on a rigid vertical support 166. The coupler member 20 and follower member 42 may thus slide toward the cushioning assembly 142 during a buff impact. Since the cushioning assembly 142 may not expand past the sill stops 152 and 154 toward the follower member 42, the cushion cap 48 will not expand into contact with the follower member 42 which would keep the follower member 42 from dropping during wear.

Figure 14:
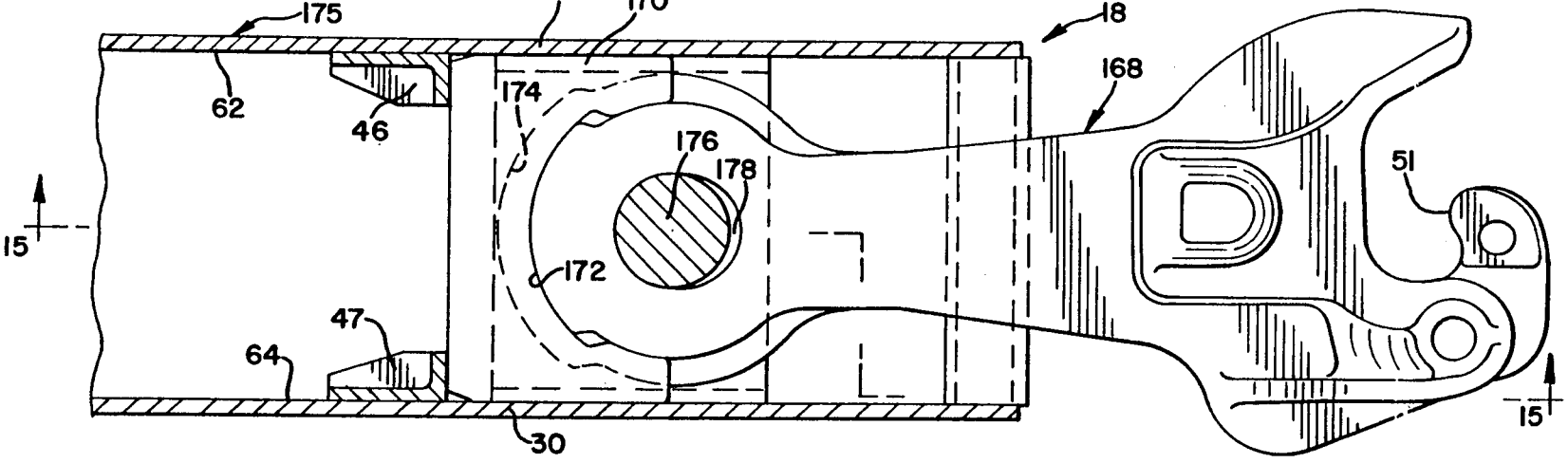
FIG. 14 is a sectional plan view of a fourth embodiment of the invention.
Figure 15:
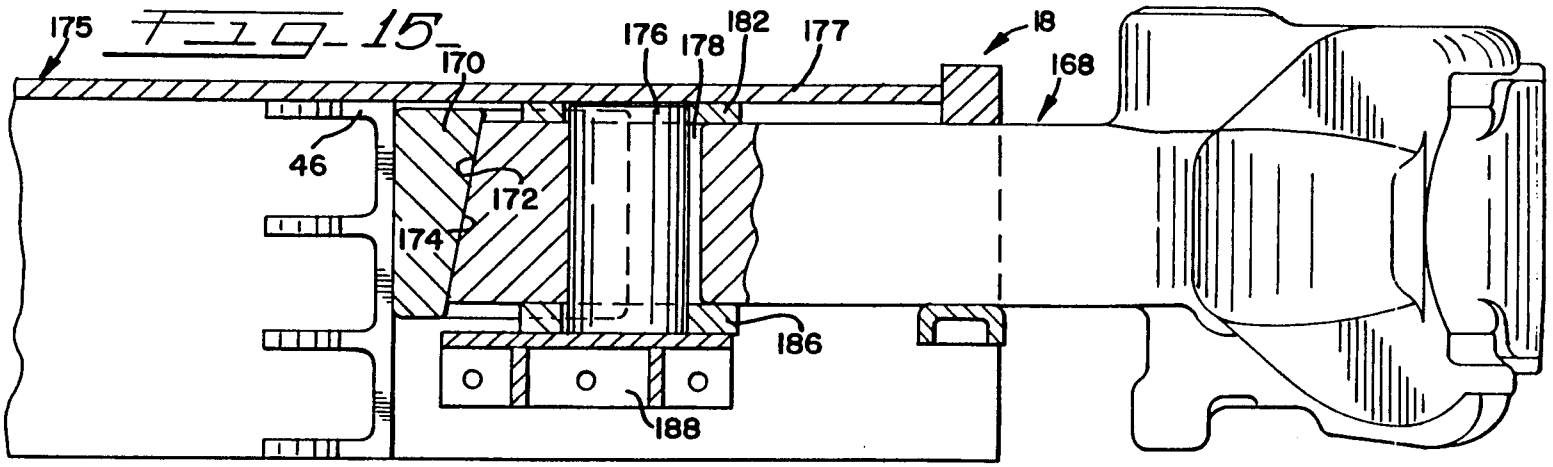
FIG. 15 is a side elevation of the fourth embodiment, partially in section taken along lines 15—15 of FIG. 14.

A fourth embodiment is shown in FIGS. 14 and 15 in which a coupler member 168 and a follower member 170 with arcuate conical surfaces 172 and 174 respectively are secured longitudinally within the center sill 175 by a draft pin 176 which extends vertically through an opening 178 in the coupler member 168 and rests on a vertical support 188 which is, in turn, bolted within the center sill 175. A length of the pin 176 is required to extend both above and below the coupler member 168 to transfer the longitudinal draft loads of the coupler member 168 to the center sill 175. A rigid reinforcement support 182 surrounds the draft pin 176 and is attached to the roof portion 177 of the center sill 24 to keep the coupler member 168 and the follower member 170 longitudinally positioned and to transfer the longitudinal draft loads from the draft pin 176 to the center sill 175. A similar rigid reinforcement support 186 is attached to the vertical support 188.

Figure 16:
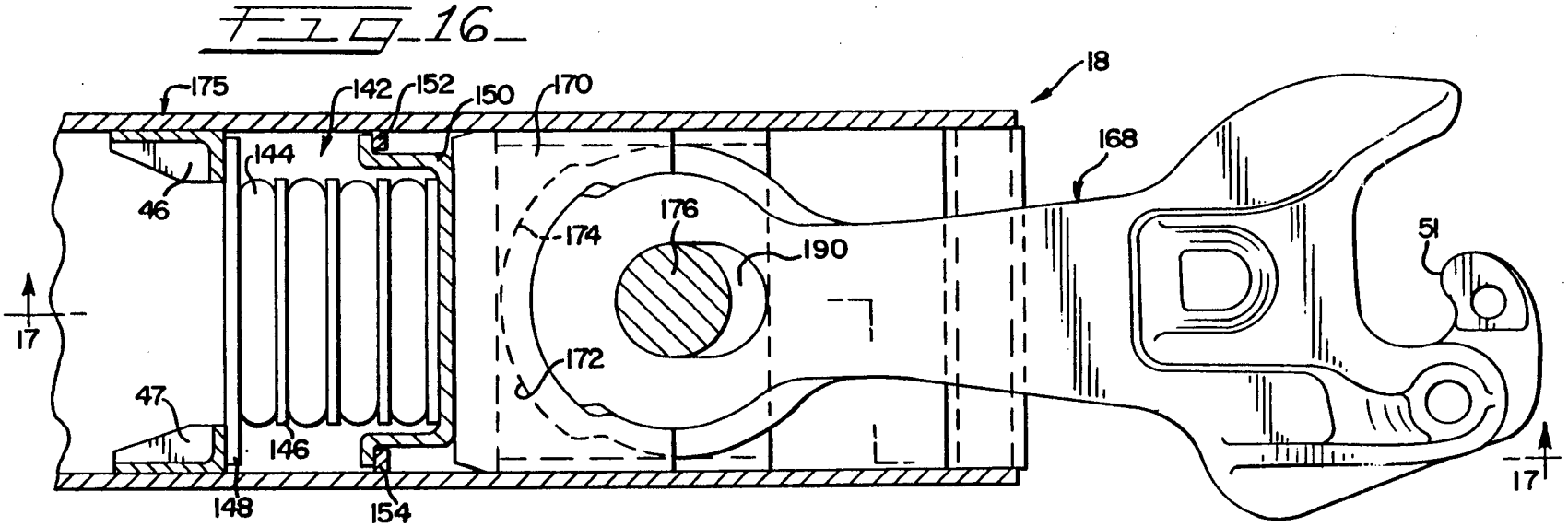
FIG. 16 is a sectional plan view of a fifth embodiment of the invention.
Figure 17:
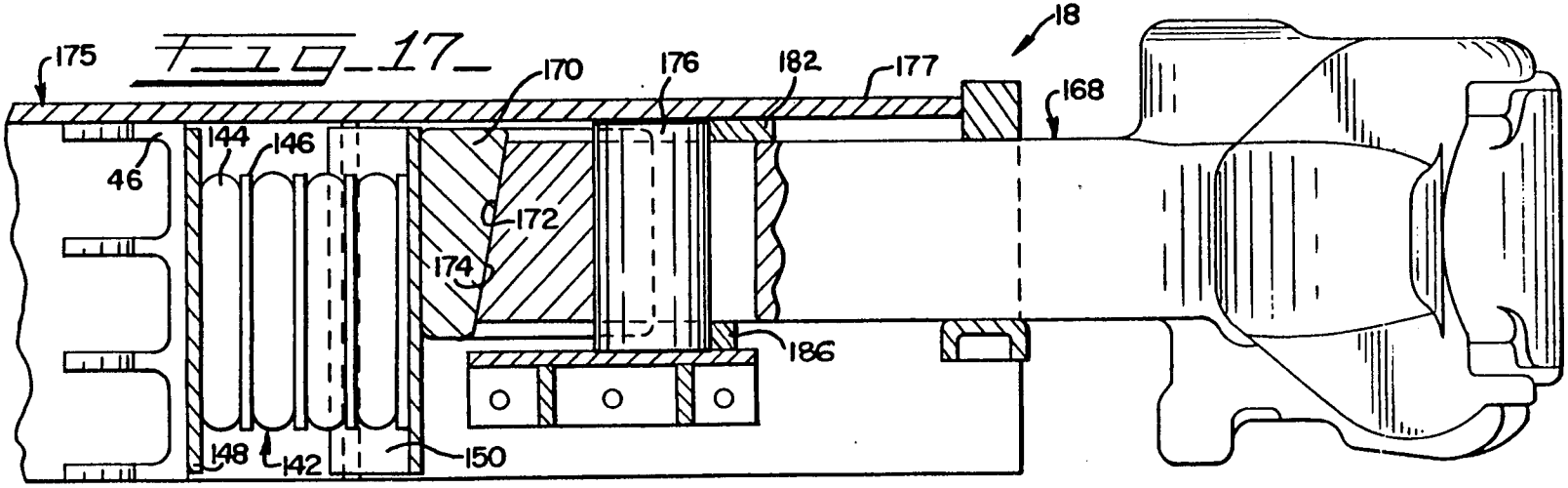
FIG. 17 is a side elevation of the fifth embodiment, partially in section taken along lines 17—17 of FIG. 16.

A fifth embodiment is shown in FIGS. 16 and 17 in which a vertical draft pin 176 is used with a cushioning assembly 142. In order to allow the coupler member 168 and the follower member 170 with arcuate conical surfaces 172 and 174 respectively to slide toward the cushioning assembly 142 within the center sill 175, a longitudinally elongated opening 190 is included in the coupler member 168. In this embodiment, only the rigid reinforcement support 182 above the coupler member 168 and the rigid reinforcement support 186 below the coupler member 168 are shown allowing for movement of the vertical draft pin 176 along with the coupler member 168 and the follower member 170 toward the cushioning member 142 during buff impact.

The foregoing description and drawings explain and illustrate the best known modes of the invention and those skilled in the art who have the disclosure before them will be able to make modifications and variations therein without departing from the scope of the invention which is defined in the following claims.

What is claimed is:

1. In an improved slackless coupler connection for a railway car of the type having a coupler member extending into a railway car center sill, said coupler member having a head end, a butt end and a shank between said head end and said butt end, said coupler member vertically restrained within said center sill, the improvement comprising:

a conical surface about said butt end of said coupler member;

a self-adjusting follower member located within said center sill, said follower member having a pocket for receiving said butt end of said coupler member, said follower member pocket having a corresponding conical surface interfacing with and in mated alignment with said conical surface about said butt end of said coupler member, said interfacing surfaces configured to allow horizontal angling of said coupler member while restraining said butt end of said coupler member in a lateral and longitudinal position within said center sill.

2. The invention according to claim 1 in which said self-adjusting follower member comprises a rear wall for abutment with a buff stop assembly, a pair of sidelegs for abutment with corresponding inner sidewalls of said center sill, and an open front end leading to said pocket for receiving said butt end of said coupler member.

3. The invention according to claim 1 in which said interfacing conical surfaces comprise rear bearing surfaces and a pair of lateral side bearing surfaces.

4. The invention according to claim 3 in which said rear bearing surfaces have a different radius of curvature than said lateral side bearing surfaces.

5. The invention according to claim 1 in which a top surface of said coupler shank is located substantially proximate a top roof portion of said center sill thereby locating said slackless coupler connection in an upper portion of said center sill.

6. The invention according to claim 1 in which an arcuate wear-resistant liner is interposed between said butt end of said coupler member and said follower member, said arcuate wear-resistant liner having an inner conical surface interfacing in mated alignment with said conical surface of said butt end of said coupler member and an outer conical surface interfacing in mated alignment with said conical surface of said follower member.

7. The invention according to claim 1 in which said coupler member is held longitudinally within said center sill by a draft key which extends horizontally through openings in said coupler member, said follower member and sidewalls of said center sill.

8. The invention according to claim 7 in which said draft key extends through reinforcing flanges in said center sill sidewalls, said reinforcing flanges located about said openings in said center sill sidewalls and extending inwardly and outwardly from said center sill side walls.

9. The invention according to claim 1 in which said coupler member is held longitudinally within said center sill by a draft pin which extends vertically through an opening in said coupler member, said draft pin engaged above and below said coupler member by rigid supports which restrict movement of said pin toward the head end of the coupler member along the longitudinal axis of said center sill.

10. The invention according to claim 1 in which said self-adjusting follower member is longitudinally and laterally stationary within said center sill.

11. The invention according to claim 2 in which said self-adjusting follower member and said coupler member are slidable along a longitudinal axis of said center sill.

12. The invention according to claim 11 in which a cushioning assembly is interposed between said rear wall of said self-adjusting follower member and said buff stop assembly.

13. The invention according to claim 12 in which said cushioning assembly comprises a flat rear bearing plate adjacent said buff stop assembly, a front cushion cap to take buff loads from said self-adjusting follower member, and a plurality of alternating elastomeric pads and spacer plates interposed between said flat rear bearing plate and said front cushion cap.

14. The invention according to claim 11 in which said slidable movement of said self-adjusting follower member and said coupler member is limited in a direction toward the head end of the coupler member along said longitudinal axis by a draft key which extends horizontally through longitudinally elongated openings in said coupler member, said follower member and side walls of said center sill.

15. The invention according to claim 11 in which said slidable movement of said follower member and said coupler member is limited in a direction toward the head end of the coupler member along said longitudinal axis by a draft pin which extends vertically through a longitudinally elongated opening in said coupler member, said draft pin engaged above and below said coupler member by rigid supports attached within said center sill, said rigid supports positioned between the pin and the head end of the coupler member.

16. In an improved slackless coupler member for use in connecting two railway cars, said coupler member having a head end, a butt end and a shank between said head end and said butt end, the improvement comprising:

an arcuate conical surface about said butt end of said coupler member.

17. The invention according to claim 16 in which said arcuate conical surface comprises a rear bearing surface and a pair of lateral side bearing surfaces, said rear bearing surface having a radius of curvature which is different from a radius of curvature on said lateral side bearing surfaces in the same horizontal plane.

18. The invention according to claim 16 in which said butt end of said coupler member includes a horizontal slot transverse to a longitudinal axis of said coupler member for receiving a draft key.

19. The invention according to claim 18 in which said horizontal slot is elongated in a direction along said longitudinal axis.

20. The invention according to claim 16 in which said butt end of said coupler member includes a vertical opening for receiving a draft pin.

21. The invention according to claim 20 in which said vertical opening is elongated in a direction along said longitudinal axis.

22. A method of constructing an improved slackless connection between a coupler member and a center sill of a railway car, said coupler member of the type which is restrained vertically during use, said method comprising: providing an arcuate conical surface about a butt end of said coupler member; providing a follower member having an open front end leading to a pocket and a rear end for abutment with a buff stop assembly; providing an arcuate conical surface about said pocket of said follower member; placing said follower member within said center sill and abutting said buff stop assembly; inserting said butt end of said coupler member through said open front end of said follower member and mating said arcuate conical surfaces thereby seating said butt end of said coupler member within said pocket of said follower member; securing said coupler member and said follower member vertically within said center sill; and securing said coupler member and said follower member longitudinally within said center sill.

23. The method of claim 22 further comprising providing an arcuate wear resistant liner having an inner arcuate conical surface and an outer arcuate conical surface; mating said inner arcuate conical surface with said arcuate conical surface about said butt end of said coupler member and mating said outer arcuate conical surface with said arcuate conical surface about said pocket of said follower member thereby seating said arcuate wear-resistant liner between said coupler member and said follower member.

24. In an improved slackless coupler connection for a railway car of the type having a coupler member extending into a railway car center sill, said coupler member having a head end, a butt end and a shank between said head end and said butt end, said coupler member vertically restrained within said center sill, the improvement comprising:

an arcuate surface about said butt end of said coupler member;

a self-adjusting follower member located within said center sill, said follower member having a pocket for receiving said butt end of said coupler member, said follower member pocket having a corresponding arcuate surface interfacing with and in mated alignment with said arcuate surface about said butt end of said coupler member, said interfacing surfaces configured to allow horizontal angling of said coupler member while restraining said butt end of said coupler member in a lateral and longitudinal position within said center sill, said follower member also having sidelegs that extend between said coupler member and side walls of said center sill; and a draft key extending horizontally through openings in said coupler member, said sidelegs of said follower member and said center sill side walls.

25. The invention according to claim 24 in which said draft key extends through reinforcing flanges in said center sill sidewalls, said reinforcing flanges located about said openings in said center sill sidewalls and extending inwardly and outwardly from said center sill sidewalls.

* * * * *

UNITED STATES PATENT AND TRADEMARK OFFICE

CERTIFICATE OF CORRECTION

PATENT NO. : 5,054,630

DATED : October 8, 1991

INVENTOR(S) : Russell G. Altherr

It is certified that error appears in the above-identified patent and that said Letters Patent is hereby corrected as shown below:

Cover Page

Assignee: Change Canon Kabushiki Kaisha, Tokyo, Japan to Amsted Industries, Incorporated. Also, change Attorney - Fitzpatrick, Cella, Harper & Scinto to Edward J. Brosius and F.S. Gregorczyk.

Signed and Sealed this

Ninth Day of February, 1993

*Attest:*

STEPHEN G. KUNIN

*Attesting Officer*

*Acting Commissioner of Patents and Trademarks*